United States Patent [19]

Kimura

[11] 4,252,315

[45] Feb. 24, 1981

[54] TRAINING AID FOR FOOT MUSCLES

[76] Inventor: Akira Kimura, 8-15, 2-chome, Higashihokima, Adachi-ku, Tokyo, Japan

[21] Appl. No.: 45,550

[22] Filed: Jun. 4, 1979

[30] Foreign Application Priority Data

Nov. 9, 1978 [JP] Japan ..... 53-153515
Nov. 9, 1978 [JP] Japan ..... 53-153516

[51] Int. Cl.[3] ..... A63B 23/04; A64B 21/18

[52] U.S. Cl. ..... 272/119; 36/132; 272/96

[58] Field of Search ..... 36/114, 132, 43, 44; 272/119, 96; 273/194 A; 128/581

[56] References Cited

U.S. PATENT DOCUMENTS

| | | | |
|---|---|---|---|
| 259,230 | 6/1882 | Sprague | 36/44 |
| 1,637,565 | 8/1927 | Gordon | 272/96 X |
| 2,545,910 | 3/1951 | Aprile | 272/119 X |
| 3,333,352 | 8/1967 | Livingston | 272/119 X |
| 3,517,928 | 6/1970 | Shanahan | 272/119 |
| 3,716,239 | 2/1973 | Goudreau | 273/194 A |

FOREIGN PATENT DOCUMENTS

| | | | |
|---|---|---|---|
| 12516 | 9/1905 | Denmark | 36/44 |

*Primary Examiner*—George J. Marlo
*Attorney, Agent, or Firm*—Lawrence I. Field

[57] ABSTRACT

A training aid for foot muscles comprising a toe portion having a core member made of heavy metal such as lead and a resilient surface member surrounding the core member, and a heel portion having a core member made of heavy metal such as lead and a resilient surface member surrounding the core member. The toe and heel portions are so shaped that they form substantially a sole configuration, when they are placed side by side on the sole of a shoe.

3 Claims, 5 Drawing Figures

TRAINING AID FOR FOOT MUSCLES

BACKGROUND OF THE INVENTION

This invention relates to a training aid for foot muscles, and more particularly a training aid which is used when installed in a shoe.

Various kinds of training aids and devices have been developed heretofore. Almost all known training aids and devices have several drawbacks. That is to say since the known training devices have special construction users experience difficulty in using them or at least require a special training time. In other words the known training devices cannot be used in usual walking or running action.

SUMMARY OF THE INVENTION

The present invention has for its object to provide a novel and useful training aid for foot muscles, by means of which a user can improve the foot muscles, while he walks or runs while wearing shoes in which the training aid is installed.

It is another object of the invention to provide a training aid for foot muscles which is simple in construction and cheap in cost.

A training aid for foot muscles according to the invention comprises a toe portion including a core member made of heavy metal and a heel portion including a core member made of heavy metal, whereby said toe and heel portions are so shaped that they form substantially a contour configuration of a sole, when they are placed side by side on the sole of a shoe.

The training aid according to the invention may be installed in the sole of the shoe between an outsole an an insole, or may be placed on an upper surface of the insole. In the latter case and toe and heel portions are covered with soft and resilient surface members, respectively. Further the surface members of the toe and heel portions are preferably connected to each other by a flexible joint portion. In a preferred embodiment of the training aid according to the invention the core members are made from lead plates having a thickness of about 5 to 10 mm, preferably 8 mm.

DESCRIPTION OF THE PREFERRED EMBODIMENTS

Figure 1:
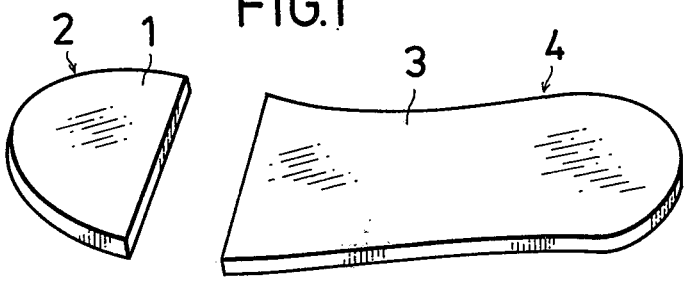
FIG. 1 is a perspective view showing toe and heel portions of the training aid according to the invention.

FIG. 1 is a perspective view showing a core member 1 of a toe portion 2 and a core member 3 of a heel portion 4. As shown in FIG. 1 the shape of toe portion 2 corresponds to a front portion of the sole and the shape of heel portion 4 corresponds to the remaining portion of the sole, i.e. the plantar arch and heel. Therefore if the toe and heel portions 2 and 4 are placed side by side, they form substantially a contour configuration of the sole. The core members 1 and 3 are made of heavy metal such as lead, iron, and the like. In this embodiment core members 1 and 3 are formed of a lead plate having a thickness of about 8 mm.

Figure 2:
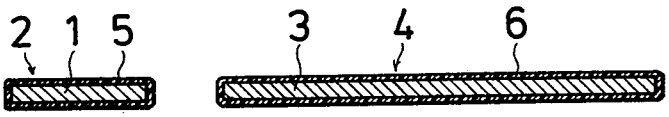
FIG. 2 is a cross section of an embodiment of the training aid according to the inventions.
Figure 3:
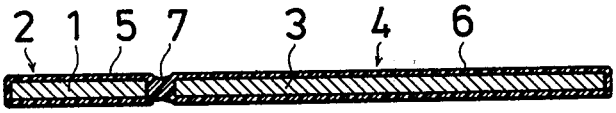
FIG. 3 is a cross section of another embodiment of the training aid according to the invention.

When the training aid according to the invention is used by being placed on an insole of a shoe, it is preferable to cover the core members 1 and 3 with flexible surface members as shown in FIGS. 2 and 3.

In FIG. 2 the core members 1 and 3 of the toe and heel portions 2 and 4 are coated uniformly with surface members 5 and 6, respectively. The surface members 5 and 6 are made of resilient high molecular material such as synthetic rubber, vinyl chloride and the like.

In FIG. 3, the core members 1 and 3 of the toe and heel portions 2 and 4 are uniformly covered with surface members 5 and 6, respectively, made of resilient material. Further the toe and heel portions 2 and 4 are connected to each other by means of a flexible joint portion 7. Therefore the toe and heel portions 2 and 4 can be bent relative to each other along the joint portion 7. In this embodiment the surface members 5 and 6 and the joint portion 7 are formed as an integral body. In order to increase the flexibility of the joint portion 7 its thickness is made locally thin.

Figure 4:
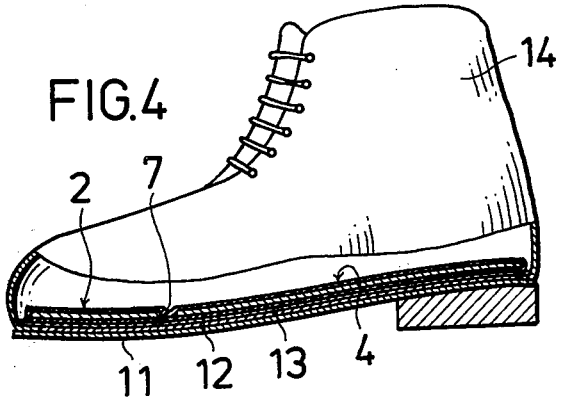
FIG. 4 is a view partly in section illustrating an embodiment of a shoe in which the training aid according to the invention is provided.

FIG. 4 is a view illustrating a shoe in which the training aid shown in FIG. 3 has been placed on an insole. The shoe 10 comprises an outsole 11, a slipsole 12, an insole 13 and a top 14. The training aid illustrated in FIG. 3 is placed on the insole 13 of shoe 10. Since the toe portion 2 and heel portion 4 are connected to each other by the joint portion 7 and the whole contour configuration of the aid substantially corresponds to the sole, the training aid of the invention cannot be displaced on the insole 13. The weight of the aid is about 1.5 kg and thus when a user walks and runs after putting on the shoes in which the training aid is installed, the user's feet are subjected to a substantial load and thus the training for foot muscles can be achieved. For instance, if the user walks a certain distance while wearing the shoes, he has to consume a momentum which would be required to walk about twice the actual distance wearing usual shoes. Further since the core members 1 and 3 are made of lead which has a flexiblity to some extent they are deformed in conformity with the sole during use. Therefore the user does not feel difficulty in walking and running. Further the training aid according to the invention has the toe and heel portions 2 and 4 which can be bent with respect to each other along the flexible joint portion 7 and thus does not hinder a natural bending movement of the sole.

Figure 5:
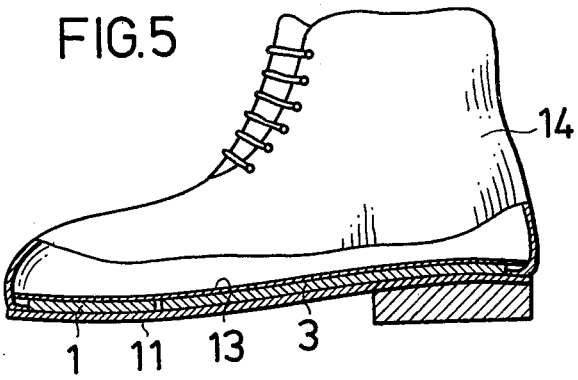
FIG. 5 is a view similar to FIG. 4 showing another embodiment of a shoe in which the training aid according to the invention is arranged.

FIG. 5 is a partially cross sectional view showing another embodiment of a shoe in which the training aid according to the invention is installed. In this embodiment the core members 1 and 3 of toe and heel portions are embedded between the outsole 11 and the insole 13. As shown in the drawing the core members 1 and 3 are arranged side by side with a certain space therebetween.

It should be noted that the present invention is not limited to the embodiments explained above, but many modifications can be conceived by those skilled in the art within the scope of the invention. For instance, the core members may be made of various heavy metals such as iron other than lead. If the core members are less flexible, they may be previously deformed in conformity with the sole. Further the surface members 5 and 6 may be formed of thick cloth having certion resiliency.

What is claimed is:

1. A training aid for foot muscles adapted to be placed on an insole of a shoe, said training aid comprising:

a toe portion including a toe core member made of lead covered with a surface member made of soft and resilient material;

a heel portion including a heel core member made of lead covered with a cover member made of soft and resilient material; and a flexible joint portion made of flexible material coupling said toe portion and said heel portion with each other and including a portion which is thinner than said covered heel and toe portions and which is disposed in such a manner that said heel portion can be bent along said thinner portion of said joint portion with respect to the toe portion and wherein said toe and heel portions are so shaped that they form substantially a contour configuration of the sole of the user's foot.

2. A training aid according to claim 1 wherein said joint portion and the cover members of said toe and heel portions are formed as an integral body of resilient high molecular material.

3. A training aid according to claim 1 wherein said core members each have a thickness of from about 5 mm to 10 mm.

* * * * *